US009082255B2

(12) United States Patent
Sasaki

(10) Patent No.: US 9,082,255 B2
(45) Date of Patent: Jul. 14, 2015

(54) GAME MACHINE

(75) Inventor: Ryu Sasaki, Minato-ku (JP)

(73) Assignee: KONAMI DIGITAL ENTERTAINMENT CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 13/607,351

(22) Filed: Sep. 7, 2012

(65) Prior Publication Data

US 2013/0072281 A1 Mar. 21, 2013

(30) Foreign Application Priority Data

Sep. 20, 2011 (JP) ..... 2011-205190

(51) Int. Cl.
*A63F 9/24* (2006.01)
*G07F 17/32* (2006.01)

(52) U.S. Cl.
CPC ..... *G07F 17/32* (2013.01); *G07F 17/329* (2013.01); *G07F 17/3297* (2013.01)

(58) Field of Classification Search
USPC ..... 463/16–20, 25–29
See application file for complete search history.

(56) References Cited

U.S. PATENT DOCUMENTS

2003/0148804 A1* 8/2003 Ikeya et al. ..... 463/16
2007/0066387 A1 3/2007 Matsuno et al.
2007/0072669 A1 3/2007 Ogiwara
2008/0254853 A1 10/2008 Wright et al.
2010/0137052 A1 6/2010 Bennett
2011/0053677 A1* 3/2011 Munakata et al. ..... 463/20

FOREIGN PATENT DOCUMENTS

| | | | |
|---|---|---|---|
| CN | 1846821 | A | 10/2006 |
| CN | 1931412 | A | 3/2007 |
| CN | 101018592 | A | 8/2007 |
| CN | 101716420 | A | 6/2010 |
| CN | 101739761 | A | 6/2010 |
| JP | 2010-088710 | A | 4/2010 |
| WO | 03/046850 | A2 | 6/2003 |
| WO | 2007/117393 | A2 | 10/2007 |

OTHER PUBLICATIONS

AU Patent Examination Report No. 1—Date of Issue Jul. 29, 2013.
Chinese Office Action with English Translation—Issued May 4, 2014.

(Continued)

*Primary Examiner* — Omkar Deodhar
(74) *Attorney, Agent, or Firm* — Howard & Howard Attorneys PLLC

(57) ABSTRACT

In the game machine which is provided with a lottery device which executes a lottery and causes a predetermined privilege when a predetermined condition is satisfied and a control unit, the control unit receives applications for participation of a plurality of players in a lottery by the lottery device on a condition of paying chips, executes a lottery by the lottery device when a total of the number of chips paid by the plurality of players whose applications for participation have been received reaches a predetermined specified number, and distributes a privilege decided by the lottery device according to a ratio of the number of chips paid by each player whose application for participation has been received.

8 Claims, 7 Drawing Sheets

(56) References Cited

OTHER PUBLICATIONS

Patent Examination Report No. 2 (AU 2012216804)—Date of Issue: Jul. 29, 2014.

Chinese Office Action with English Translation; Date Issued: Dec. 25, 2014.

* cited by examiner

GAME MACHINE

CROSS-REFERENCE TO RELATED APPLICATIONS

The present application claims the benefit of patent application number 2011-205190, filed in Japan on Sep. 20, 2011, the subject matter of which is hereby incorporated herein by reference.

TECHNICAL FIELD

The present invention relates to a game machine including a lottery device.

BACKGROUND ART

Game machines including a lottery device are well known (for example, see Patent Literature 1). A pusher game in which in a medal game machine, a group of medals placed on a table is pushed out and then fall onto a predetermined medal falling portion by reciprocation of a pusher table has been known. Besides medals, balls are placed on the table, and the balls fall onto the falling portion with the movement of the medals. As the medals or the balls fall onto the falling portion, a predetermined game process is executed. A lottery process by a lottery device is executed as an example of a game process.

Patent Literature 1: JP-A-2010-088710.

SUMMARY OF INVENTION

Technical Problem

A lottery by a lottery device is performed for a player who has satisfied a condition for executing a lottery process. Typically, as payout of a lottery increases, a condition for acquiring a lottery right becomes stricter, and so an opportunity to execute a lottery process per player is reduced. Further, since a target of a lottery is one player, a player who is not a target of a lottery may have a low interest in a lottery, and there may be a lack of excitement in an overall game machine.

Thus, the present invention aims to provide a game machine which is capable of executing a lottery process in which a plurality of players participates.

Solution to Problem

The game machine of the present invention is a game machine comprising: a lottery device which executes a lottery to decide a privilege to be given to a player; a participation application receiving device which receives applications for participation of a plurality of players in a lottery by the lottery device on a condition of paying a game value; a lottery executing device which executes a lottery by the lottery device when a total of the number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device.

According to the game machine of the present invention, the player who desires to participate in a lottery by the lottery device pays a game value and requests for participation.

When a total of the number of game values paid by the players who have applied for participation satisfies the specified number, a lottery by the lottery device is executed. When a lottery is won, a privilege is distributed according to a ratio of the number of game values paid by the player to the specified number. Typically, as payout of a lottery increases, a condition for acquiring a lottery right becomes stricter, and so an opportunity to execute a lottery process per player is reduced. However, since each player shares and pays the game value, a condition for acquiring a lottery right per player becomes moderate, and thus it is easy to acquire an opportunity to execute a lottery of higher payout. Since a plurality of players is allowed to participate in a lottery, a game becomes exciting, and amusement of a game can be increased.

As one aspect of the game machine of the present invention, further comprising a execution instruction determining device which determines whether or not the player has given an execution instruction to request execution of a lottery of the lottery device on a condition of paying a game value, wherein when the execution instruction determining device determines that the player has given the execution instruction, the participation application receiving device receives an application for participation in the lottery from another player other than the player who has requested execution of the lottery of the lottery device. According to this, the execution instruction can be given at the time when the player desires to execute the lottery by the lottery device. Further, another player can pay a game value necessary to satisfy the specified number and participate in the lottery. A game's property can be diversified, and amusement of a game can be increased.

As one aspect of the game machine of the present invention, the participation application receiving device includes an insufficient game value presenting device which presents the other player with the number of game values necessary to satisfy the specified number. According to this, another player who desires to participate in the lottery can understand the number of game values to be paid to participate in.

As one aspect of the game machine of the present invention, the lottery device changes a winning probability of the lottery or content of the privilege according to the number of players whose applications for participation have been received by the participation application receiving device. A game's property can be diversified. Further, as one aspect of the game machine of the present invention, the lottery device changes a winning probability of the lottery or content of the privilege according to an amount of the specified number.

As one aspect of the game machine of the present invention, comprising a plurality of stations which respectively include a game field on which a medal as a first game medium and a second game medium different from the medal are arranged and a pusher table reciprocating along the game field, wherein in the station, a pusher game in which a group of medals placed on below the second game medium is pushed out of the game field by the pusher table is executed, and the second game medium is acquired as the second game medium is pushed out of the game field, and the game system further comprising a game value managing device which exchanges the acquired second game medium to the game value and manages the game value possessed by the player. According to this, the game medium acquired in the pusher game is exchanged to the game value. As the game medium is acquired, the game value is stored. The player is motivated to continue a game aimed at a lottery by the lottery device.

As the aspect of comprising the plurality of stations, the privilege is payout of medals. Further, the second game medium is a ball.

Advantageous Effects of Invention

As described above, according to the invention, the player who desires to participate in a lottery by a lottery device pays a game value and requests for participation. When a total of the number of game values paid by the players who have applied for participation satisfies the specified number, a lottery by the lottery device is executed. When a lottery is won, a privilege is distributed according to a ratio of the number of game values paid by the player to the specified number. Typically, as payout of a lottery increases, a condition for acquiring a lottery right becomes stricter, and so an opportunity to execute a lottery process is reduced. However, since each player shares and pays the game value, a condition for acquiring a lottery right per player becomes moderate, and thus it is easy to acquire an opportunity to execute a lottery of higher payout. Since a plurality of players is allowed to participate in a lottery, a game becomes exciting, and amusement of a game can be increased.

DESCRIPTION OF EMBODIMENTS

Figure 1:
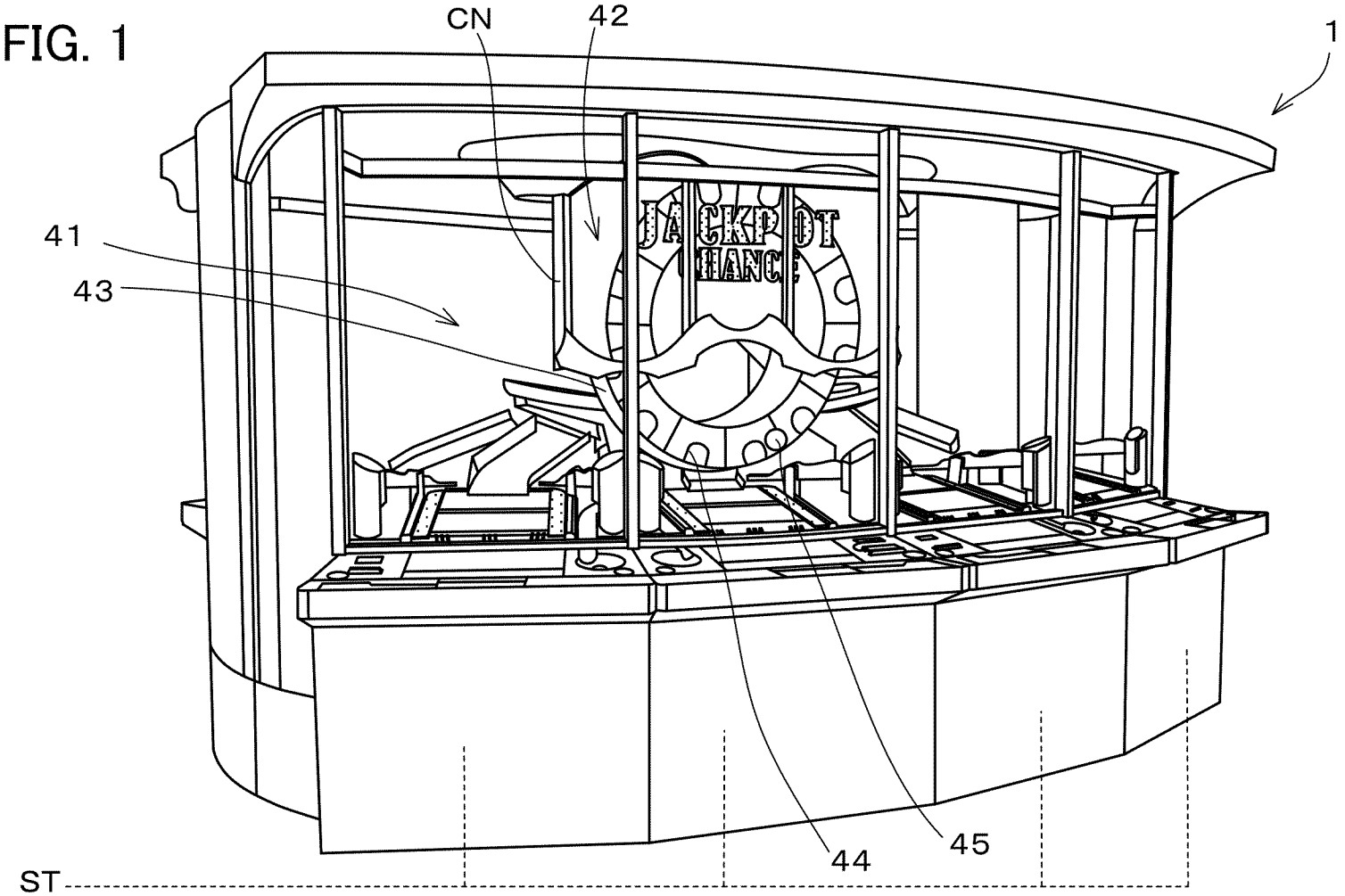
FIG. 1 is a perspective view of a game machine according to one aspect of the present invention.

FIG. 1 is a perspective view of a game machine that configures a game system according to one aspect of the present invention. A game machine 1 is a so-called medal game machine that uses a medal M as first game medium. The game machine 1 includes a center unit CN and a plurality of station units ST. The center unit CN is arranged at the center of the game machine 1, and executes a bonus game corresponding to a game result of the station unit ST. The station unit ST is arranged around the center unit CN. For example, eight station units ST are arranged such that four station units ST and four station units ST are arranged at both sides, respectively with the center unit CN interposed therebetween. The station unit ST executes a so-called pusher game using a medal and a digital lottery game corresponding to a game result of the pusher game.

Figure 2:
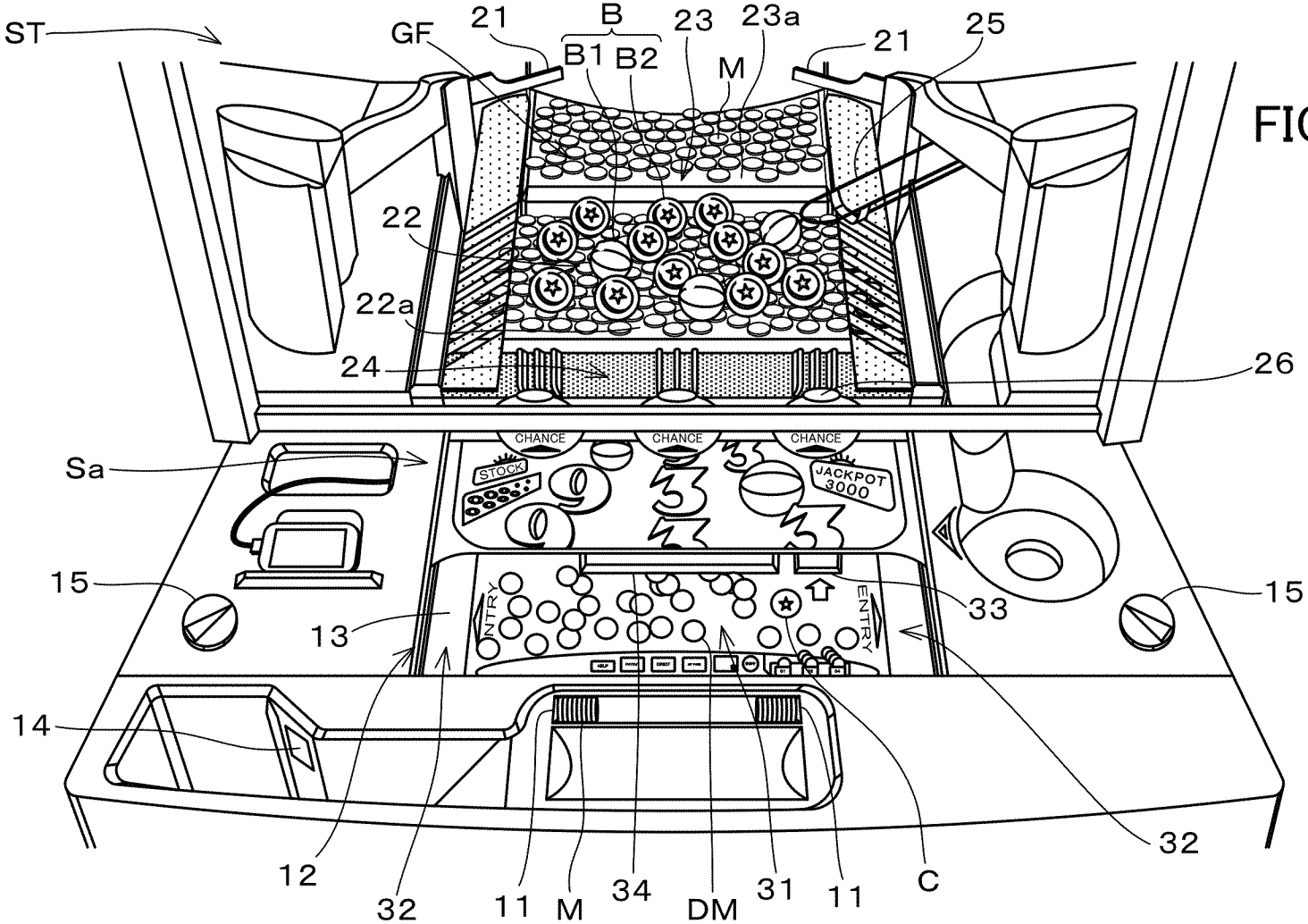
FIG. 2 is a perspective view of a station unit.

FIG. 2 is a perspective view of the station unit ST. The station unit ST includes a game field GF in which a pusher game is executed. The station unit ST is provided with a medal insertion slot 11 through which the medal M is inserted into the game field GF, a monitor 12, a transparent touch panel 13 superimposed on the surface of the monitor 12, a medal dispensing opening 14 that dispenses the medal M according to a result of a game executed by each station unit ST or the center unit CN, a rail operating portion 15 which will be described below. Two medal insertion slots 11 are disposed in each station unit ST. Thus two players can simultaneously play through a single station unit ST.

A game screen Sa is displayed on the monitor 12. In FIG. 2, a slot game is displayed on an upper portion of the monitor 12, and an operating unit 31 that operates a digital medal DM and a chip C as second game medium is displayed on a lower portion of the monitor 12. A slot game refers to a digital lottery game which a control unit 61, which will be described later, executes according to a game result of the game field GF. The operating unit 31 is provided with a digital medal insertion slot 32 into which the digital medal DM is inserted, a chip insertion slot 33 into which the chip C is inserted, and a digital medal dispensing opening 34. As the digital medal DM is guided to the digital medal insertion slot 32 by a touch operation, the actual medal M is inserted into the game field GF. One digital medal DM is equivalent to one actual medal M, however, for example, one digital medal DM may be set to be equivalent to three medals M.

Besides, a digital lottery game different from that in FIG. 2, a rendering effect at the time of winning, or the like is appropriately displayed on the monitor 12 depending on a game result of each station unit ST or the center unit CN. Through the touch panel 13, a touch operation associated with an image such as the digital medal DM displayed on the monitor 12 or an operation button of the digital lottery game can be made. The actual medal M is dispensed through the medal dispensing opening 14. The station unit ST may dispense the digital medal DM instead of dispensing the actual medal through the medal dispensing opening 14. In this case, an image of the digital medal DM dispensed through the digital medal dispensing opening 34 or the number of acquired medals is displayed.

The station unit ST includes a medal supply rail 21 that supplies the game field GF with the medal M, a table 22 on which the medal M and the ball B are placed, a pusher table 23 that reciprocates on the table 22, a falling portion 24 that is positioned at a front end of the table 22 and onto which the medal M and the ball B fall, a ball supply rail 25 that supplies the table 22 with the ball B, and a checker 26 that detects the medal M. The medal supply rail 21 supplies the medal M onto the pusher table 23 in response to insertion of the medal M into the medal insertion slot 11 or an insertion operation of the digital medal DM through the touch panel 13. A direction of the medal supply rail 21 is changed by operating the rail operating portion 15. Thus, it is possible to change the direction of the medal M guided to the game field GF. The pusher table 23 reciprocates in a front-back direction by a driving mechanism 64 (see FIG. 6). The medal M and the ball B pushed out by the pusher table 23 fall onto the falling portion 24. The checker 26 is disposed at the position adjacent to the falling portion 24. A digital lottery game is executed based on detection of the medal M by the checker 26. The digital lottery game is displayed on the monitor 12. The table 22 and the pusher table 23 configure the game field GF. Further, when the ball B falls onto the falling portion 24, a process corresponding to the type of fallen ball B is executed. A medal detecting portion 62 (see FIG. 6) which is disposed at an appropriate position of the game field GF detects the medal M, and a ball detecting portion 63 (see FIG. 6) detects the ball B. A well-known technique such as a photoelectric sensor may be used to detect the medal M or the ball B. The ball supply rail 25 supplies the ball B to the table 22 depending on a game result of each station unit ST or the center unit CN.

Next, the move of the medal M in the game field GF will be briefly described. When the medal M is inserted into the medal insertion slot 11, the medal M is supplied to a medal placing surface 23*a* of the pusher table 23 through the medal supply rail 21. A group of medals on the medal placing surface 23*a* is pushed out by reciprocation of the pusher table 23, and some medals are moved to a medal placing surface 22*a* of the table 22. The ball B is placed on a group of medals on the medal placing surface 22*a*. A group of medals is pushed out by reciprocation of the pusher table 23, and the ball B moves with the movement of a group of medals. The medal M fallen onto the falling portion 24 is dispensed from the medal dispensing opening 14. Further, the medal M that has entered the checker 26 is detected by the medal detecting portion 62. A game process of a slot game illustrated in FIG. 2 is executed based on the detection result. An orb ball B1 and a chip ball B2 are provided as the ball B placed on the table 22. Here, when the orb ball B1 falls onto the falling portion 24, the digital lottery game is executed, and the chip ball B2 is collectable as the chip C. A process corresponding to the type of fallen ball B is executed.

Figure 3:
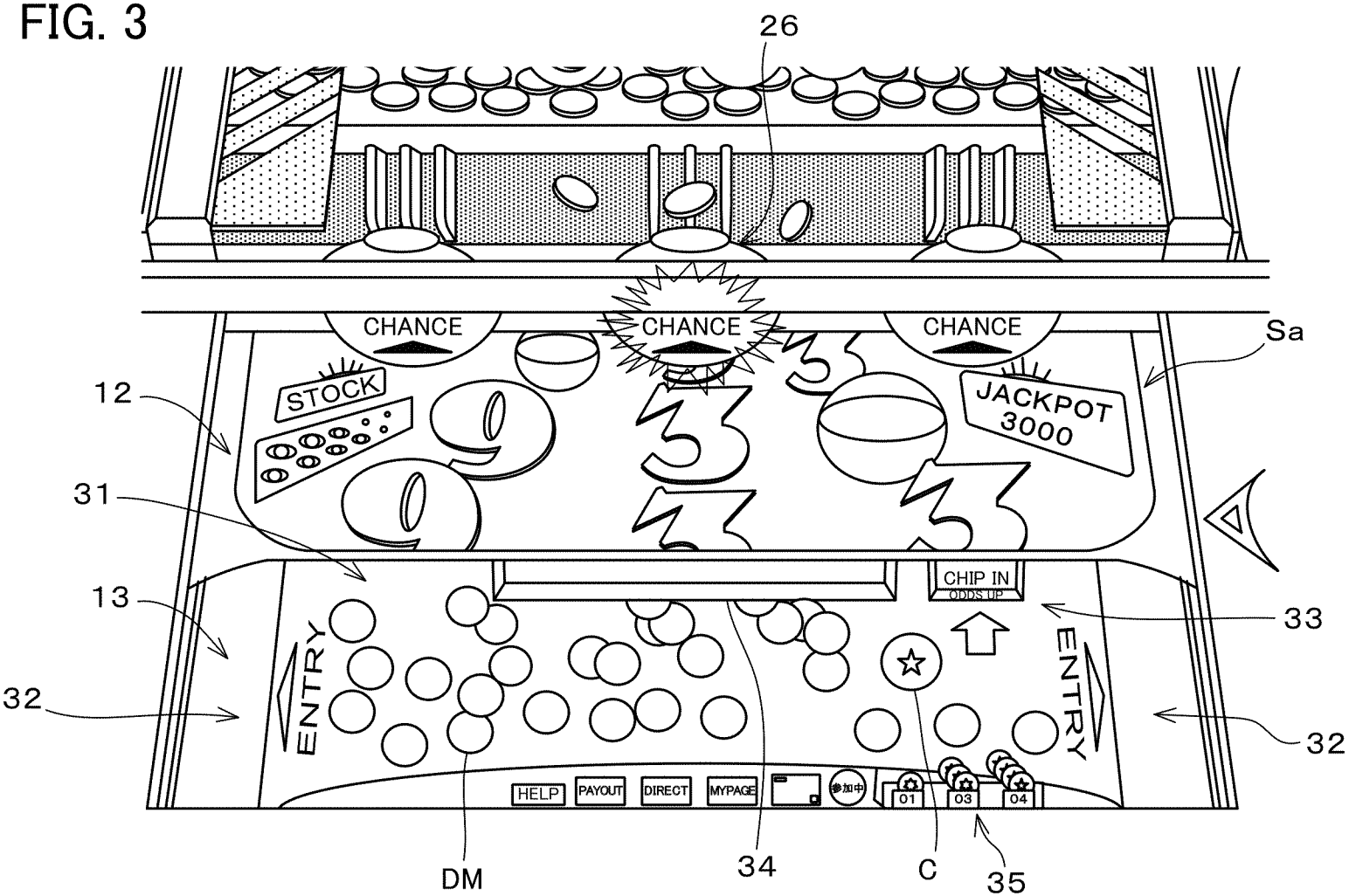
FIG. 3 is a diagram to describe use of a chip.

The chip ball B2 fallen onto the falling portion 24 is detected by the ball detecting portion 63. The player acquires the chip C based on the detection result. The player acquires one chip C when one chip ball B2 falls. Two or more types of chip balls B2 may be provided, and the type of acquirable chip C or the number of acquirable chips C may differ according to the type of chip ball B2. Alternatively, the chip C may be acquired depending on the game result of each station unit ST or the center unit CN. FIG. 3 is a diagram illustrating a usage of the chip C. When the player inserts the chip C displayed on the monitor 12 into the chip insertion slot 33 by a touch operation, payout of the digital lottery game executed based on the detection result of the checker 26 becomes higher payout during a predetermined time period. In FIG. 3, the slot game is executed as the digital lottery game. For example, if thirty medals are paid out at a normal time, 100 medals are paid out when the chip C is used. When the chip C is used, a rendering effect of the slot game may change. Further, when the chip C is used, a winning probability of the digital lottery game may be set to be higher than a normal time. Further, one chip C1 may be exchanged with a predetermined number of medals, for example, 10 medals M. The player may collect the chip C, the possessed chip C is displayed on a possessed chip display portion 35. Two or more types of chips C may be provided. In this case, the number of possessed chips may be displayed on the possessed chip display portion 35 for each type of chip C. Furthermore, by using chip C, the player can participate in a bingo jackpot game which will be described below.

The center unit CN executes a jackpot game when a "jackpot chance" is won in a lottery game executed by each station unit ST. Referring back to FIG. 1, the center unit CN will be described. The center unit CN is provided with a lottery mechanism 41 and a monitor 42. The lottery mechanism 41 is provided with a rotating plate 43 that rotates, a plurality of lottery holes 44 disposed in the rotating plate 43, and a lottery ball 45 that enters the lottery hole 44. The lottery mechanism 41 executes a roulette game as a jackpot game. When the lottery ball 45 enters any one of the lottery holes 44, the medals M which are equal in number to the number associated with the corresponding lottery hole 44 are dispensed to the player. When the jackpot game is executed, a predetermined rendering effect is displayed on the monitor 42. Even when the jackpot game is not displayed, a predetermined rendering effect may be displayed to boost a game.

Figure 4:
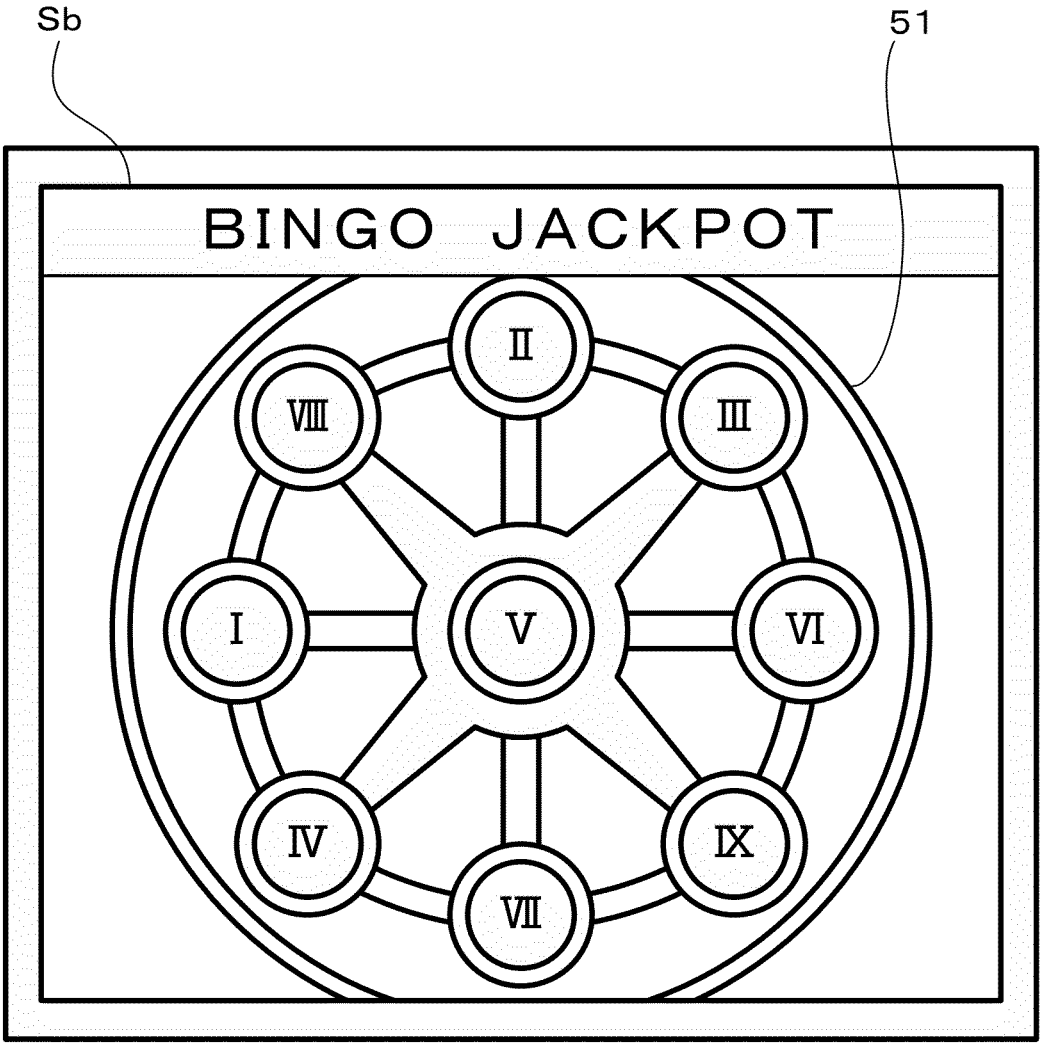
FIG. 4 is a diagram illustrating an example of a game screen of a bingo jackpot game.

In addition to a typical jackpot game, a cooperative jackpot game is displayed on the monitor 42. FIG. 4 is a diagram illustrating an example of a game screen Sb of the cooperative jackpot game. A bingo jackpot game is executed as the cooperative jackpot game. A bingo card 51 illustrated in FIG. 4 is displayed on the monitor 42. The bingo card 51 has a configuration in which 9 circular boxes are arranged in a 3×3 matrix, and any one numerical value of 1 to 9 is appropriately arranged in each circular box (in FIG. 4, a Roman numeral is displayed in each circular box). A digital lottery as a lottery device using a random number is executed as a lottery of each circular box. Alternatively, a lottery in which a numerical value of each circular box is associated with a lottery hole 44 of a lottery mechanism 41 may be executed. Alternatively, a lottery of each circular box may be performed using a lottery device disposed in the station unit ST. In the bingo card 51, a circular box corresponding to a numerical value selected by a lottery becomes effective. When three effective circular boxes are arranged in a line in a vertical direction, a horizontal direction, or a diagonal direction in the bingo card 51, bingo is established. A privilege corresponding to a line of established bingo is given to a player. The cooperative jackpot game allows a plurality of players to participate in. The details will be described later.

Figure 5:
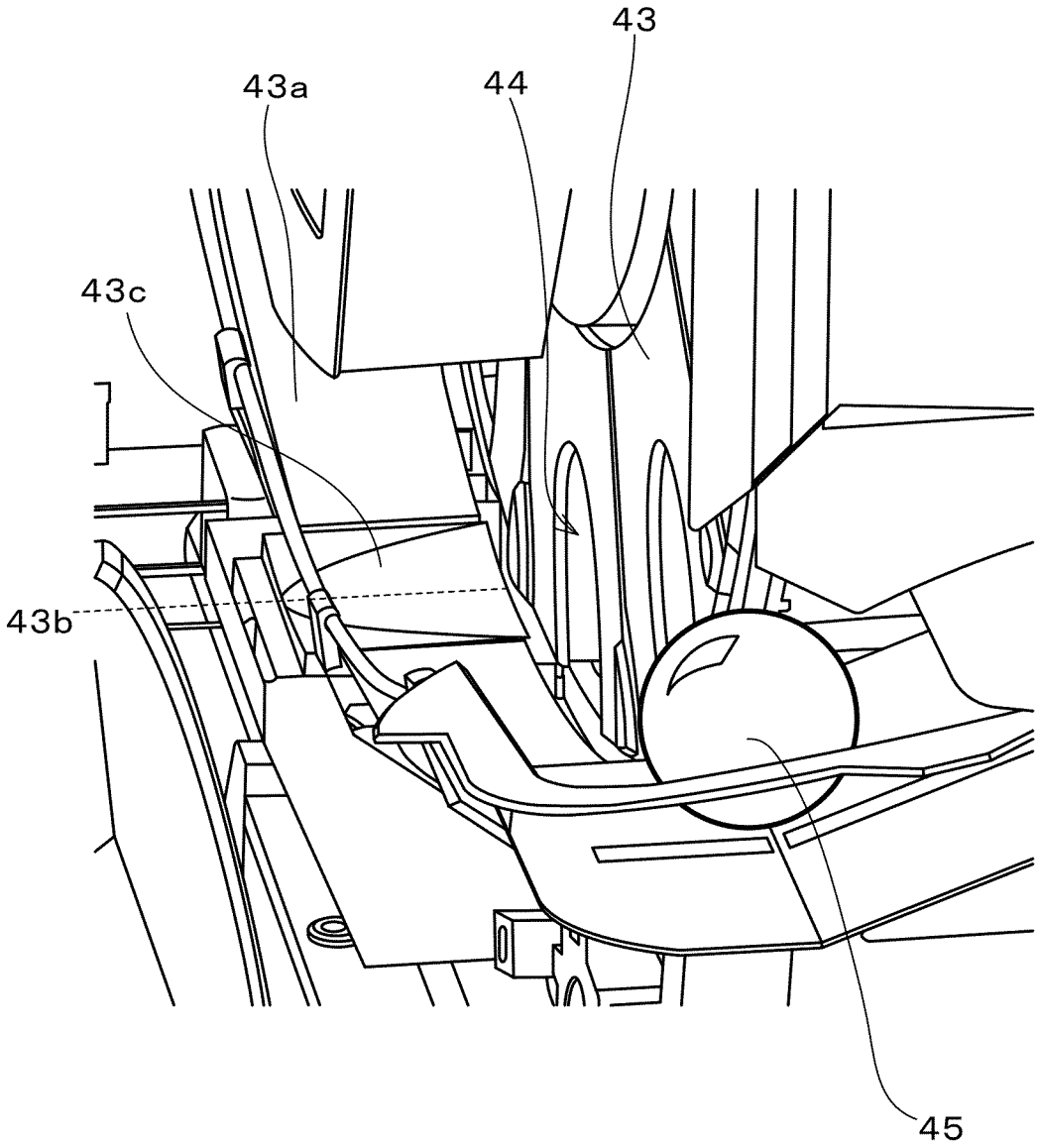
FIG. 5 is an enlarged view of a main part of a lottery mechanism.

FIG. 5 is an enlarged view of a main part of the lottery mechanism 41. In the lottery mechanism 41, since a board surface of a rotating plate 43 that performs a roulette game is supported in the vertical direction, a lottery ball 45 enters the lottery hole 44 while reciprocating on the lowest point 43*b* on a ball rail 43*a* disposed at the position adjacent to the end portion of the rotating plate 43. A timing at which the lottery ball 45 enters the lottery hole 44 depends on movement of the lottery ball 45 and rotation of the rotating plate 43 but may be adjusted to some extent by an adjusting member 43*c* disposed in the lowest point 43*b* on the ball rail 43*a*. The adjusting member 43*c* adjusts an angle formed between the adjusting member 43*c* and the rotating plate 43 so that the lottery ball 45 can easily enter the lottery hole 44. When the angle formed between the adjusting member 43*c* and the rotating plate 43 decreases, the lottery ball 45 is subjected to force in the direction of the rotating plate 43 when passing through the adjusting member 43*c*, and thus the lottery ball 45 easily enters the lottery hole 44. On the other hand, when the angle formed between the adjusting member 43*c* and the rotating plate 43 increases, it is difficult for the lottery ball 45 to enter the lottery hole 44.

The game machine 1 includes a motor 67 that drives the adjusting member 43*c*. Driving of the motor 67 is controlled by a control unit 61 (see FIG. 6). The control unit 61 controls driving of the motor 67 such that the angle formed between the adjusting member 43*c* and the rotating plate 43 decreases when an average of a lottery time in a most recent predetermined time period is larger than a predetermined target time with reference to history of a lottery time necessary for a lottery stored for each lottery by the lottery mechanism 41 in a storage device 68 (see FIG. 6) of the game machine 1. Further, when the average of the lottery time is smaller than the target time, the control unit 61 controls driving of the motor 67 such that the angle formed between the adjusting member 43*c* and the rotating plate 43 increases. The target time may have a certain width, and when the average of the lottery time falls into the target time, the target time may not be adjusted. The target time may be set not only at the time of shipment of the game machine 1 but also at a store in which the game machine 1 is installed. In this case, a dedicated menu for setting the target time may be disposed in the game machine 1, and the target time may be set by an operator of a store. Here, the lottery time refers to a time between when the lottery ball 45 is supplied to the lottery mechanism 41 and when the lottery ball 45 enters the lottery hole 44 and then a lottery result is decided.

In a conventional lottery mechanism using a ball, each game machine differs in a lottery time due to influence of an installation state of a game machine. Thus, depending on a game machine, there was a case in which a lottery is not performed within a range of a desired lottery time. It is because depending on a status of a store, a game machine may be installed on a tilt or may be inclined during use due to some reason. For this reason, in the related art, the adjusting member is manually adjusted, but it was not easy to evaluate an adjustment result, and it was difficult to appropriately adjust the adjusting member. Further, due to a characteristic of a lottery mechanism, a lottery time is not constant due to a physical factor even though an installation state of a game machine is constant, and it was difficult to perform proper evaluation based on a single lottery result. In this regard, by controlling the motor 67 such that the angle formed between the adjusting member 43*c* and the rotating plate 43 is adjusted based on the average of the lottery time and the target time, the lottery time by the lottery mechanism 41 can be adjusted to fall into the target time. Further, since it is unnecessary for the operator to manually perform an adjustment, it is easy to manage the game machine 1.

Figure 6:
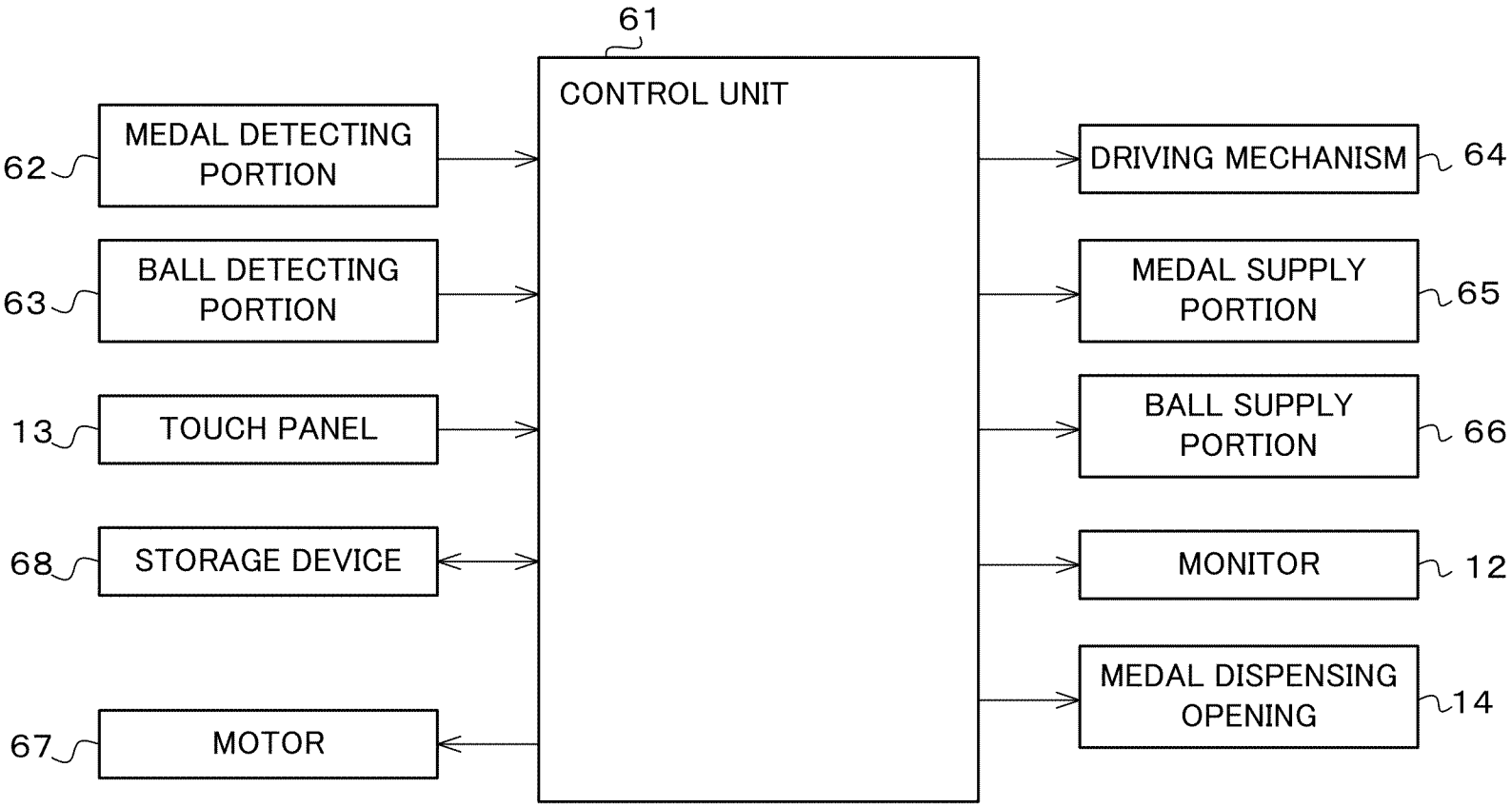
FIG. 6 is a functional block diagram illustrating a configuration of a control system of a game machine.

FIG. 6 is a functional block diagram illustrating a configuration of a control system of the game machine 1. The game machine 1 includes the control unit 61 that executes various control processes for executing a predetermined game. The control unit 61 is configured as a computer unit in which a microproces sing unit (MPU) is combined with peripheral devices necessary to operate the MPU such as a random access memory (RAM) and a read only memory (ROM). The control unit 61 is connected with the touch panel 13, the medal detecting portion 62 that detects the medal M on the game field GF, and the ball detecting portion 63 that detects the ball B on the game field GF, and receives a signal necessary to control a game. Further, the control unit 61 is connected with control targets such as the driving mechanism 64 that causes the pusher table 23 to reciprocate, a medal supply portion 65 that supplies the game field GF with the medal M, a ball supply portion 66 that supplies the game field GF with the ball B, the monitor 12, and the medal dispensing opening 14 that dispenses the medal M to the player. The medal supply portion 65 supplies the medal M to the game field GF through the medal supply rail 21 based on lottery results of various lottery games executed by the game machine 1. The ball supply portion 66 supplies the ball B to the table 22 through the ball supply rail 25 based on lottery results of various lottery games executed by the game machine 1. Further, depending on the lottery result of the lottery game, the medal M is dispensed from the medal dispensing opening 14 directly to the player. Further, control may be performed such that the digital medal DM is dispensed instead of the medal M. The control unit 61 is further connected with the storage device 68. In the game machine 1, the number of chips C acquired by the player is stored in the storage device 68 and managed by the control unit 61 according to the progress of a game. In addition, the storage device 68 stores a game program for executing a game through the game machine 1 and a variety of data necessary to execute a game.

Figure 7:
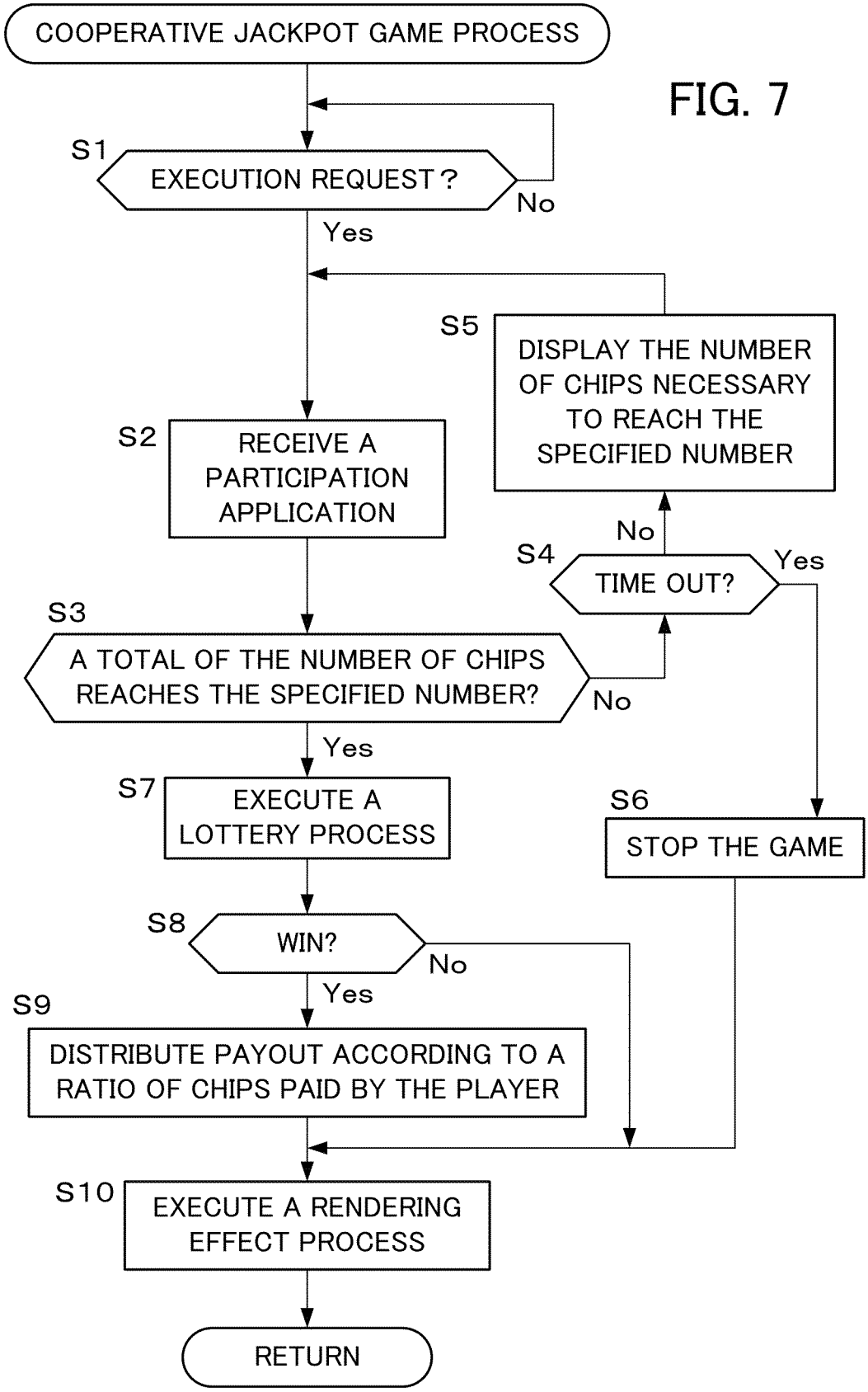
FIG. 7 is a flowchart illustrating a cooperative jackpot game process routine executed by a control unit.

FIG. 7 is a flowchart illustrating a cooperative jackpot game process routine executed by the control unit 61. The cooperative jackpot game allows a plurality of players to participate in. Specifically, the cooperative jackpot game is executed on the condition that a specified number of chips C are paid by a plurality of players. In this case, when a total of the number of paid chips C paid by a plurality of players reaches the specified number, the cooperative jackpot game is executed. In step S1, the control unit 61 determines whether or not the player makes a cooperative jackpot game execution request. The player who desires to execute the cooperative jackpot game performs a touch operation of touching an execution request button displayed on the monitor 12. An execution request operation may be assigned to an operating unit such as a button disposed on the station unit ST as well as the touch panel 13. The player decides the number of chips C to be paid for the current cooperative jackpot game and inputs the decided number of chips C. For example, when 100 chips C are set as the specified number, the player decides the number of chips C to be paid within a range from 1 to 100. Before an operation related to the execution request, the number of chips C to be paid by the player may be designated in advance. The execution request operation is received at any time at the player's desire during game execution of the game machine 1. When it is determined that the execution request has not been made, the control unit 61 repeats the process of step S1.

When it is determined in step S1 that the player has been made the execution request, the control unit 61 causes the process to proceed to step S2 and receives a participation application from other players. A screen of encouraging selection about whether or not to participate in a current cooperative jackpot game is displayed on the monitor 12 of the station unit ST other than the station unit ST operated by the player who has made the execution request in step S1. The player who has decided to participate in and applied for participation inputs the number of chips C to pay. In this case, the player who is to participate in decides the number of chips C to pay within the number of chips necessary to reach the specified number.

In step S3, the control unit 61 determines whether or not a total of the number of chips paid by the players who are to participate in a current game reaches the specified number. When 100 chips C are set as the specified number, when a total of the number of chips C paid by the player who has made the execution request in step S1 and the players who have applied for participation in step S2 is 100, the specified number is satisfied. For example, when the player who has made the execution request for the cooperative jackpot game has paid 100 chips, the specified number is satisfied. Further, when the player who has made the execution request has paid 50 chips C and two players who have applied for participation have paid 20 chips and 30 chips respectively, the specified number is satisfied. When it is determined in step S3 that a total of the number of chips C does not reach the specified number yet, the control unit 61 causes the process to proceed to step S4 and then determines whether or not a current participation application times out. After the execution request is received in step S1, a participation application is determined to time out when a predetermined time elapses after a participation application starts to be received in step S2. When it is determined in step S4 that a current participation application does not time out, the control unit 61 causes the process to proceed to step S5, and causes the number of chips C necessary to reach the specified number to be displayed on the monitor 12. This encourages the player to participate in. Then, the control unit 61 returns to step S2, and repeats the process. However, when it is determined in step S4 that a current participation application times out, in step S6, the control unit 61 stops the current bingo jackpot game and pays the paid chips C back to the players. Then, the control unit 61 causes the process to proceed to step S10 and displays a rendering effect of notifying the players of the fact that the current cooperative jackpot game is not to be executed. Then, the current process ends.

Meanwhile, when it is determined in step S3 that a total of the number of chips C reaches the specified number, the control unit 61 causes the process to proceed to step S7 and then executes a lottery process of the cooperative jackpot game. The control unit 61 executes the lottery process using a random number or the like. Alternatively, the lottery mechanism 41 may execute the lottery process. A well-known technique may be used for the lottery process. Then, in step S8, the control unit 61 determines whether or not a lottery is won as a result of the lottery process of step S7. The number of medals M to be paid to the player is set according to a line on which a bingo is formed as well as a jackpot as a win. When it is determined in step S8 that a lottery is not won, the control unit 61 causes the process to proceed to step S10 and then causes a rendering effect of notifying the participant players of the fact that the lottery is not won to be displayed on each monitor 12.

When it is determined in step S8 that the lottery is won, the control unit 61 causes the process to proceed to step S9 and then distributes obtained payout according to a ratio of chips C paid by the player who has participated in the cooperative jackpot game. For example, when a single player has paid all of the chips C, the player receives the full payout. Further, when three players have paid 50 chips, 30 chips, and 20 chips respectively, 50% of payout is paid to the player who has paid 50 chips, 30% of payout is paid to the player who has paid 30 chips, and 20% of payout is paid to the player who has paid 20 chips. The payout is paid according to the ratio of the number of chips C paid by each player to the specified number of chips C. Then, in step S10, the control unit 61 displays a rendering effect of notifying each player of the fact that the lottery is won and the number of medals acquired by each player. Then, the current process ends. When it is set to dispense a predetermined number of medals M to the game field GF as payout, the medals M which correspond in number to the ratio of the number of paid chips C to the predetermined number of medals M are dispensed from the medal supply portion 65 to the game field GF of the station unit ST of each player who has participated in the cooperative jackpot game through the medal supply rail 21. Alternatively, when it is set to pay out a predetermined number of medals M directly to the player as payout, the medals M which correspond in number to the ratio of the number of paid chips C to the predetermined number of medals M are dispensed through the medal dispensing opening 14 of each player who has participated in the cooperative jackpot game.

According to the cooperative jackpot game process, by the player's execution request (step S1), other players are encouraged to participate in the cooperative jackpot game (step S2), and when a total of the number of chips C paid by the players satisfies the specified number necessary to execute the cooperative jackpot game (step S3), the lottery process is executed (step S7). When the lottery is won as a result of the lottery (step S8), payout is distributed according to a ratio of the number of chips paid by each player (step S9). Thus, since a plurality of players challenge a jackpot game of higher payout in a cooperative manner, a sense of connectedness among players who play with a single machine 1 can increase, excitement of a game can be increased, and amusement of a game can be increased. Even though it is difficult for one person to execute a jackpot game, since an opportunity to execute a jackpot game is given to the player by seeking other player's cooperation, it is easy to obtain an opportunity to acquire higher payout, and players are motivated to continue a game. In the related art, a jackpot game is executed when a predetermined condition is satisfied, whereas in the invention, a jackpot game can be executed based on a player's intension. Thus, the progress of a game can be diversified, and amusement of a game can be increased.

In the above process, the process of step S7 of the cooperative jackpot game process executed by the control unit 61 functions as a lottery device, the process of step S2 functions as a participation application receiving device, the process of step S3 functions as a lottery executing device, the process of step S9 functions as a privilege distributing device, the process of step S1 functions as an execution instruction determining device, and the process of step S5 functions as an insufficient game value presenting device. Further, the control unit 61 functions as a game value managing device.

The invention is not limited to the above embodiment and may be embodied in various forms. For example, in the present embodiment, other players are encourage to participate in a cooperative jackpot game by the execution request of the player in step S1 of the cooperative jackpot game process, but the invention is not limited to this example. For example, a message to encourage participation in a cooperative jackpot game may be constantly displayed on the monitor 12, and step S1 may not be performed. Further, the lottery process of step S7 may be executed when the player requests for participation and a total of the number of paid chips C satisfies the specified number.

The present embodiment has been described in connection with the example in which 100 chips are set as the specified number as an example, but the invention is not limited to this example. For example, 10 chips, 200 chips, or an arbitrary number of chips may be set as the specified number. The player may be allowed to set the specified number. Alternatively, the player may select any one from among a plurality of specified number choices. The number of chips C to participate may be set to a certain amount. In this case, a predetermined number of participant players need to be collected to satisfy the specified number, and a privilege is equally distributed when a game is won.

In the above embodiment, a winning probability may change according to an amount of the specified number. The winning probability may increase in proportion to the amount of the specified number. Further, the amount of payout may change according to an amount of the specified number. That is, the amount of payout may increase according to the number of chips C necessary to be paid as an execution condition to execute a lottery. Further, the winning probability may change according to the number of people who are participated in the cooperative jackpot game. For example, as the number of participants increases, the wining probability may increase. Since many players are involved, a game becomes exciting, and amusement of a game can be increased. Alternatively, as the number of participants decreases, the wining probability may increase. In this case, since a lottery is executed by a small number of participants, many chips C are paid. The chip C has been described as a game value, and the game value is not limited to this example. For example, the medal M may be used as the game value. Alternatively, one given as a result of the slot game executed based on a detection result of the medal M on the game field GF may be used as the game value. The game value may be appropriately set depending on a game. A privilege at the time of winning is not limited to payout of the medal M and may include prize of the chip C, an item effective to develop a game, or the like. For example, the ball B may be supplied to the game field GF. In this case, the ball B is supplied from the ball supply portion 66 to the table 22 through the ball supply rail 25. Alternatively, a lottery game executed by each station unit may be performed a predetermined number of times as a privilege, and the predetermined number of times may be allocated.

In the present embodiment, the bingo jackpot game has been described as the cooperative jackpot game, but the invention is not limited to this example. For example, a slot game, a roulette game, or the like may be performed as the cooperative jackpot game. Further, a digital lottery of step S7 executed by the control unit 61 has been described as a lottery device, but the invention is not limited to this example. A lottery may be performed by the lottery mechanism 41. A configuration of the lottery mechanism may be appropriately changed depending on a game.

What is claimed is:

1. A game machine comprising:

a center unit including a lottery device which executes a lottery to decide a privilege to be given to a player;

a plurality of station units, each of the station units including a participation application receiving device which receives applications for participation of a plurality of players in a lottery by the lottery device on a condition of paying a game value; and a control unit coupled to the center unit and to each of the plurality of station units, the control unit including:

a lottery executing device which determines a number of game values paid by each of the plurality of players, determines a total number of game values as a function of the number of games values paid by each of the plurality of players, and executes a lottery by the lottery device when the total number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device, wherein the control unit changes a winning probability of the lottery or content of the privilege according to the number of players whose applications for participation have been received by the participation application receiving device.

2. The game machine of claim 1, further comprising a execution instruction determining device which determines whether or not the player has given an execution instruction to request execution of a lottery of the lottery device on a condition of paying a game value, wherein when the execution instruction determining device determines that the player has given the execution instruction, the participation application receiving device receives an application for participation in the lottery from another player other than the player who has requested execution of the lottery of the lottery device.

3. A game machine comprising:

a lottery device which executes a lottery to decide a privilege to be given to a player;

a plurality of station units, each of the station units including a participation application receiving device which receives applications for participation of a plurality of players in a lottery by the lottery device on a condition of paying a game value; and a control unit coupled to each of the plurality of station units, the control unit including:

a lottery executing device which executes a lottery by the lottery device when a total of the number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device;

wherein the participation application receiving device includes an insufficient game value presenting device which presents an other player with the number of game values necessary to satisfy the specified number.

4. A game machine comprising:

a lottery device which executes a lottery to decide a privilege to be given to a player;

a plurality of station units, each of the station units including a participation application receiving device which receives applications for participation of a plurality of players in a lottery by the lottery device on a condition of paying a game value; and a control unit coupled to each of the plurality of station units, the control unit including:

a lottery executing device which executes a lottery by the lottery device when a total of the number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device;

wherein the lottery device changes a winning probability of the lottery or content of the privilege according to the number of players whose applications for participation have been received by the participation application receiving device.

5. A game machine comprising:

a lottery device which executes a lottery to device a privilege to be given to a player;

a plurality of station units, each of the station units including a participation application receiving device which receives applications for participation of a plurality of players in a lottery by the lottery device on a condition of paying a game value; and a control unit coupled to each of the plurality of station units, the control unit including:

a lottery executing device which executes a lottery by the lottery device when a total of the number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device;

wherein the lottery device changes a winning probability of the lottery or content of the privilege according to an amount of the specified number.

6. A game machine comprising a plurality of stations which respectively include a game field on which a medal as a first game medium and second game medium different from the medal are arranged and a pusher table reciprocating along the game field, wherein in at least one of the stations, a pusher game in which a group of medals placed on below the second game medium is pushed out of the game field by the pusher table is executed, and the second game medium is acquired as the second game medium is pushed out of the game field;

a game value managing device which exchanges the acquired second game medium to the game value and manages the game value possessed by the player;

a lottery device which executes a lottery to decide to privilege to be given to the player;

a participation application receiving device which receives applications for participation of a plurality of players in a lottery by the lottery device on a condition of paying a game value;

a lottery executing device which executes a lottery by the lottery device when a total of the number of game values paid by the plurality of players whose applications for participation have been received by the participation application receiving device reaches a predetermined specified number; and a privilege distributing device which distributes a privilege decided by the lottery device according to a ratio of the number of game values paid by each player whose application for participation has been received by the participation application receiving device.

7. The game machine of claim 6, wherein the privilege is payout of medals.

8. The game machine of claim 6, wherein the second game medium is a ball.

* * * * *

UNITED STATES PATENT AND TRADEMARK OFFICE

CERTIFICATE OF CORRECTION

PATENT NO. : 9,082,255 B2
APPLICATION NO. : 13/607351
DATED : July 14, 2015
INVENTOR(S) : Ryu Sasaki It is certified that error appears in the above-identified patent and that said Letters Patent is hereby corrected as shown below:

In the specification,

Column 13, Line 1: Please delete "decide to privilege" and replace with -- decide a privilege --

Signed and Sealed this
Fifth Day of April, 2016

Michelle K. Lee

Michelle K. Lee
*Director of the United States Patent and Trademark Office*